US008317053B2

(12) United States Patent
Cronin et al.

(10) Patent No.: US 8,317,053 B2
(45) Date of Patent: Nov. 27, 2012

(54) CONTAINER HAVING CONTAINER LID THREADED TO CONTAINER BOTTOM

(75) Inventors: Edward P. Cronin, Brodhead, WI (US); George Solowiejko, Rockford, IL (US); Joseph P. Valley, III, Roscoe, IL (US)

(73) Assignee: J.L. Clark, Inc., Rockford, IL (US)

( * ) Notice: Subject to any disclaimer, the term of this patent is extended or adjusted under 35 U.S.C. 154(b) by 0 days.

(21) Appl. No.: 13/043,300

(22) Filed: Mar. 8, 2011

(65) Prior Publication Data

US 2012/0228298 A1 Sep. 13, 2012

(51) Int. Cl.

| | |
|---|---|
| ***B65D 41/04*** | (2006.01) |
| ***B65D 41/06*** | (2006.01) |
| ***B65D 55/02*** | (2006.01) |
| ***B65B 7/28*** | (2006.01) |

(52) U.S. Cl. ..... 220/290; 220/293; 220/296; 215/43; 215/222; 215/329

(58) Field of Classification Search ..... 215/331, 215/344, 330, 44, 318, 325, 242, 356–357, 215/329, 43, 222, 224; 206/528, 540, 272, 206/264, 246, 5.1; 220/253, 290, 293, 296; 222/494, 93, 83; *A24F 23/04; B65D 85/10*
See application file for complete search history.

(56) References Cited

U.S. PATENT DOCUMENTS

| | | | | |
|---|---|---|---|---|
| 3,255,908 | A * | 6/1966 | Braun | 215/329 |
| 4,098,421 | A * | 7/1978 | Foster | 215/321 |
| 4,770,308 | A * | 9/1988 | Lynn | 215/330 |
| 5,307,945 | A * | 5/1994 | Hidding et al. | 215/329 |

* cited by examiner

*Primary Examiner* — Steven A. Reynolds
*Assistant Examiner* — James M Van Buskirk
(74) *Attorney, Agent, or Firm* — Reinhart Boerner Van Deuren P.C.

(57) ABSTRACT

A container having a container lid and container bottom as well as a method of assembling the same is provided. In one aspect, the container lid and container bottom have cooperating locking catch portions that inhibit rotational motion therebetween. In one embodiment, the locking catch portion of the container lid is provided by a segment of a thread thereof. In another aspect, an attachment rib is provided by the container bottom that is interposed between adjacent threads. The attachment rib is used to axially engage a thread of the container lid when axially snapping the container lid to the container bottom. A method of assembling the container lid to the container bottom is provided that includes axially snap engaging the thread of the container lid with the attachment rib of the container bottom.

17 Claims, 12 Drawing Sheets

CONTAINER HAVING CONTAINER LID THREADED TO CONTAINER BOTTOM

FIELD OF THE INVENTION

This invention generally relates to plastic containers having a container lid and a container body for storing products and methods of assemblying a container lid on a container body.

BACKGROUND OF THE INVENTION

Containers are used to store all kinds of commercial products. Containers such as for smokeless tobacco or candy are often sized to put in a consumers pocket and to fit comfortably in a user's hand. These containers will typically include a container bottom that defines a cavity for storing the product and a container lid that attaches to the container bottom that provides for repeatedly accessing the contents stored therein. The present invention provides improvements over the state of the container art, and particularly the state of containers sized to be inserted into a pant pocket or shirt pocket.

BRIEF SUMMARY OF THE INVENTION

A new and improved container and method of assembling a container is provided. In one aspect, the new and improved container includes a pair of locking catch portions that inhibit rotation of the container lid relative to the container bottom. In another aspect, the container bottom includes attachment ribs that facilitate axial snap engaging a container lid onto a container bottom during mass filling processes. These aspects according to embodiments of the invention may be used in combination or separately.

As such, in one embodiment, a container comprising a container bottom and a container lid is provided. The container bottom includes a generally annular sidewall defining a storage cavity. The sidewall includes a radially inward extending thread. The sidewall includes a first locking catch portion. The container lid includes an annular skirt sized to be received into the annular sidewall of the container bottom. The skirt includes a radially outward extending thread configured to cooperate with the radially inward extending thread to threadedly secure the container lid to the container bottom. The skirt includes a second locking catch portion. The second locking catch portion engages the first locking catch portion when the container lid is in a locked position relative to the container bottom.

In a more particular embodiment, the first locking catch portion is a generally axially extending projection projecting radially inward. The axially extending projection is axially interposed between a bottom of the container bottom and the radially inward extending thread.

In one embodiment, the locking catch portion is formed as part of the radially outward extending thread. The locking catch portion forms a leading portion of the thread that is angularly spaced from a trailing portion of the thread by an angular gap interposed therebetween. The first locking catch portion received within the gap when the container lid is in the locked position relative to the container bottom.

In one embodiment, the first locking catch portion is directly connected to the radially inward extending thread such that no gap is formed between. In a more particular embodiment, the first locking catch portion and the radially inward extending thread generally form an "L-shaped" portion.

In one embodiment, the annular sidewall includes a distal end defining an abutment surface and the container lid includes a radially outward extending rim that defines an abutment flange providing an abutment surface. The rim is radially outward of the annular skirt. The abutment surface of the annular sidewall axially abutting the abutment surface of the rim when the container lid is in the locked position relative to the container bottom.

In another embodiment, the container includes a container bottom and a container lid. The container bottom includes a generally annular sidewall defining a storage cavity. The sidewall includes a radially inward extending first thread. The sidewall includes a radially inward extending attachment rib extending at an angle relative to the radially inward extending first thread. The container lid includes an annular skirt sized to be received into the annular sidewall of the container bottom. The skirt includes a radially outward extending thread configured to cooperate with the radially inward extending first thread to threadedly secure the container lid to the container bottom.

In one embodiment, the annular sidewall has a distal end spaced apart from a bottom portion of the container bottom. The attachment rib extends angularly about a central axis of the annular sidewall generally parallel to the distal end of the annular sidewall. In one embodiment, the attachment rib has a zero lead angle.

In one embodiment, the annular sidewall includes a radially inward extending second thread. Adjacent ends of the first and second threads are angularly spaced apart from one another forming an angular gap between the first and second threads. At least a portion of the attachment rib is positioned angularly between the adjacent ends of the first and second threads and above a portion of the angular gap.

In one embodiment, the attachment rib is positioned entirely angularly between spaced apart ends of the adjacent threads such that angular gaps are formed between the first thread and the attachment rib and the second thread and the attachment rib. In one embodiment, the attachment rib does not axially overlap the second thread.

In one embodiment, the annular sidewall includes a radially inward extending second thread, the attachment rib being angularly interposed between trailing ends of the first and second threads.

In one embodiment, the attachment rib axially overlaps a portion of the first thread.

In one embodiment, the threads have a non-zero lead angle and the attachment rib has a zero lead angle.

In one embodiment, the attachment rib is spaced vertically above the thread.

In one embodiment, the container lid includes an outer rim positioned radially outward from the annular skirt. The outer rim including a plurality of gripping ribs. The gripping ribs extending radially outward beyond an outer surface of the annular sidewall when the container lid is mounted to the container bottom.

In one embodiment, the container lid includes a top portion and an outer rim positioned radially outward from the annular skirt. The container lid includes a shoulder that transitions the top portion into the outer rim. The shoulder includes a plurality of angularly spaced apart gripping dimples. In a more particular embodiment, the gripping dimples are generally elliptical in cross-section and the spacing between adjacent dimples is less than a major axis of the dimples.

In a further aspect, a method of assembling a container includes axially mounting a container lid to a container bottom; engaging, axially, a radially outward extending thread of the container lid with a radially inward extending attachment rib of the container bottom including axially passing the thread past the attachment rib such that the container lid is secured to the container bottom; rotating the container lid relative to the container bottom such that the radially outward extending thread of the container lid angularly engages a radially inward extending thread of the container bottom axially securing the container lid to the container bottom with the cooperating threads.

In a more particular method, rotating further includes angularly engaging a first locking catch portion of the container bottom with a second locking catch portion of the container bottom such that the first locking catch portion inhibits unthreading the container lid from the container bottom.

In one embodiment, the method further includes axially abutting a distal end of an annular sidewall of the container bottom with an abutment surface of the container lid.

In one method, the container lid includes a plurality of gripping ribs that extend radially outward beyond the container bottom. Rotating the container lid includes engaging a plurality of the gripping ribs with a rotating torquing wheel and rotating the container lid with the rotating wheel.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
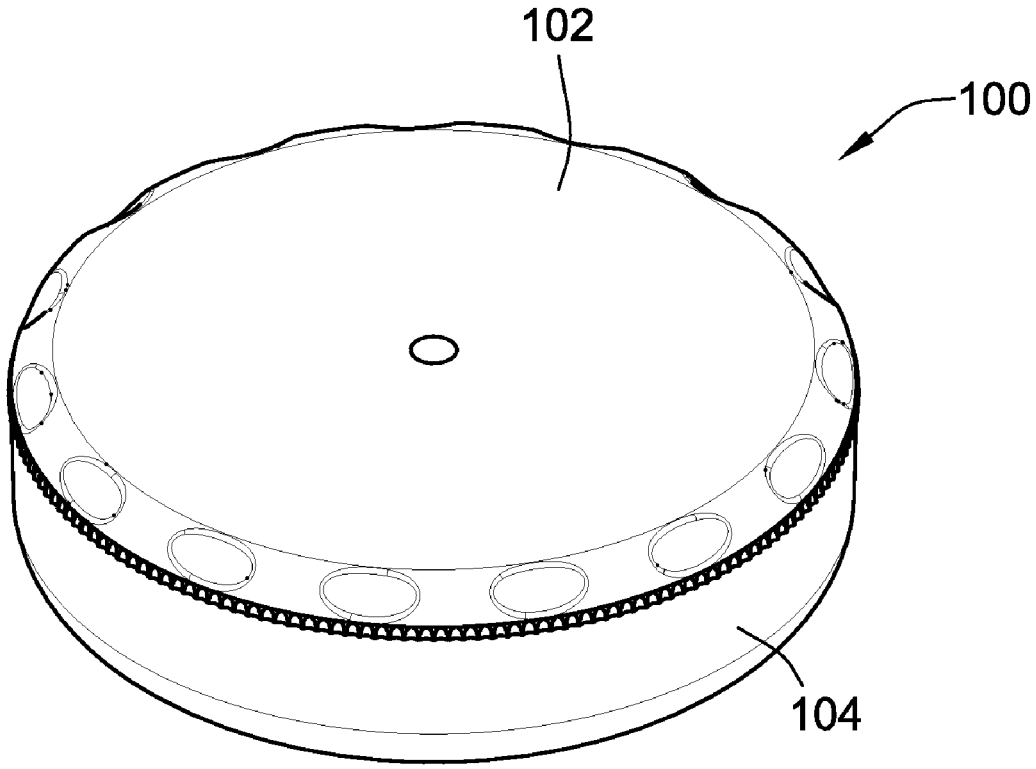
FIG. 1 is a top perspective illustration of a container according to an embodiment of the present invention.

Turning now to FIG. 1, an exemplary embodiment of a container 100 according to the present invention is illustrated. The container 100 includes a container lid 102 and a container bottom 104. The container lid 102 is releasably attached tot the container bottom 104 to provide access to an interior thereof where product can be stored. For instance, candies, tobacco, or other product can be stored in the container 100 such that the user can selectively open the container 100, remove a select quantity of the product, and then re-secure the container lid to secure the product within the container 100.

The container lid 102 and container bottom 104 are preferably formed from injection molded plastic. However, other materials can be used in other embodiments that incorporate inventive aspects of the present invention. For instance, the container lid 102 and container bottom 104 could be formed from thin metal.

Figure 2:
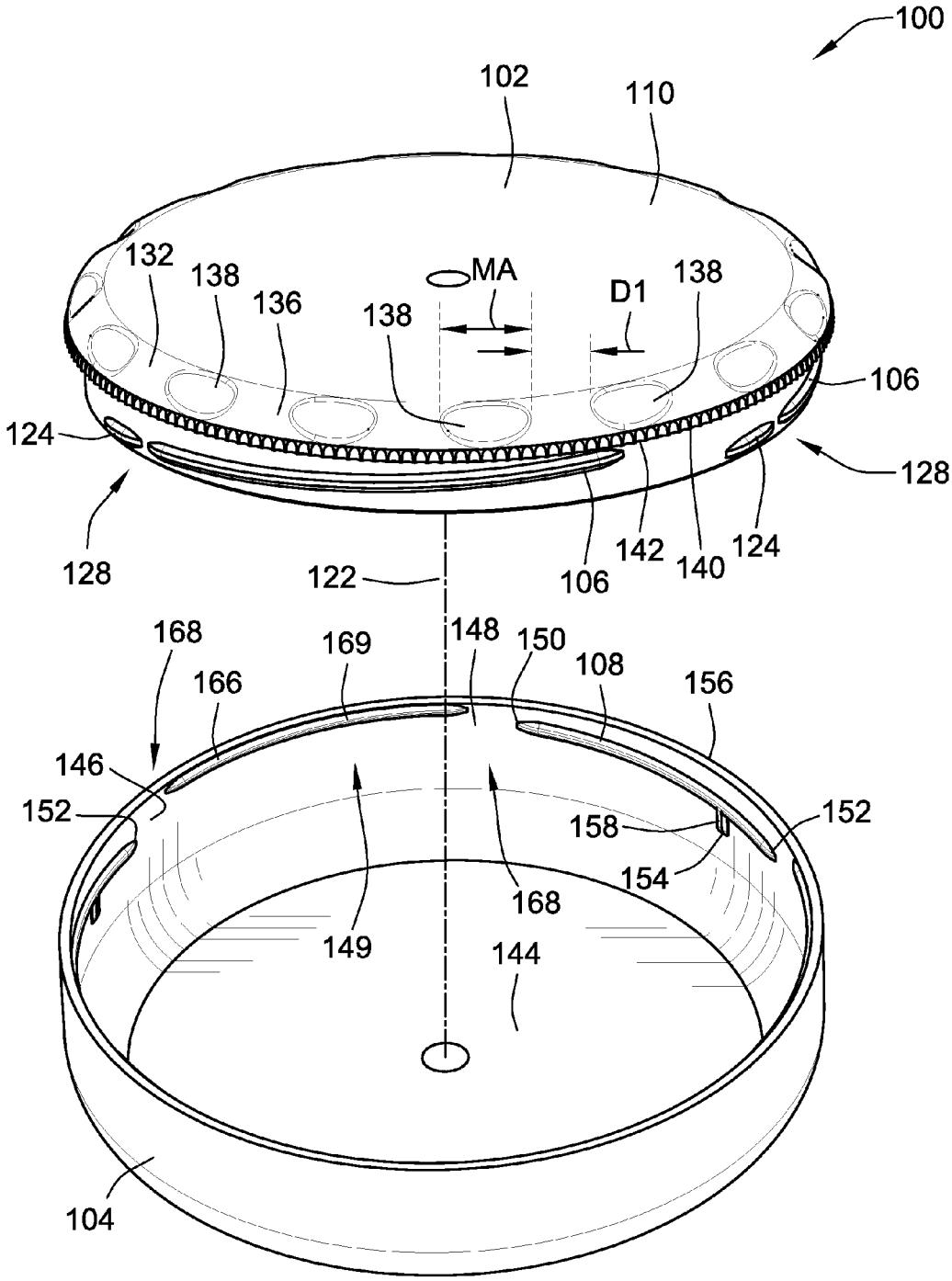
FIG. 2 is a top exploded perspective illustration of the container of FIG. 1.

With reference to FIG. 2, the container lid 102 includes a plurality of threads 106 that cooperate with corresponding threads 108 of the container bottom 104. The cooperating threads 106, 108 facilitate releasably securing the container lid 102 to the container bottom 104. More particularly, a user can rotatably twist the container lid 102 relative to the container bottom 104 to threadedly secure or remove the container lid 102 to or from the container bottom 104.

The container lid 102 includes a top portion 110 that is generally planar. A skirt portion 112 depends axially downward from the top portion 110. The threads 106 of the container lid 102 are radially outward extending threads that extend radially outward from a radially outer surface 114 of skirt portion 112. In the illustrated embodiment, there are three threads 106 that are angularly spaced apart from one another. With additional reference to FIG. 3, a leading end 116 of one thread 106 is angularly spaced from a trailing end 118 of an adjacent thread such that a gap 120 is formed therebetween. In other words, the adjacent threads 106 of the illustrated embodiment do not axially overlap with one another such that no adjacent thread is axially, in the direction of rotational axis 122, above or below another one of the radially outward extending threads 106.

Figure 3:
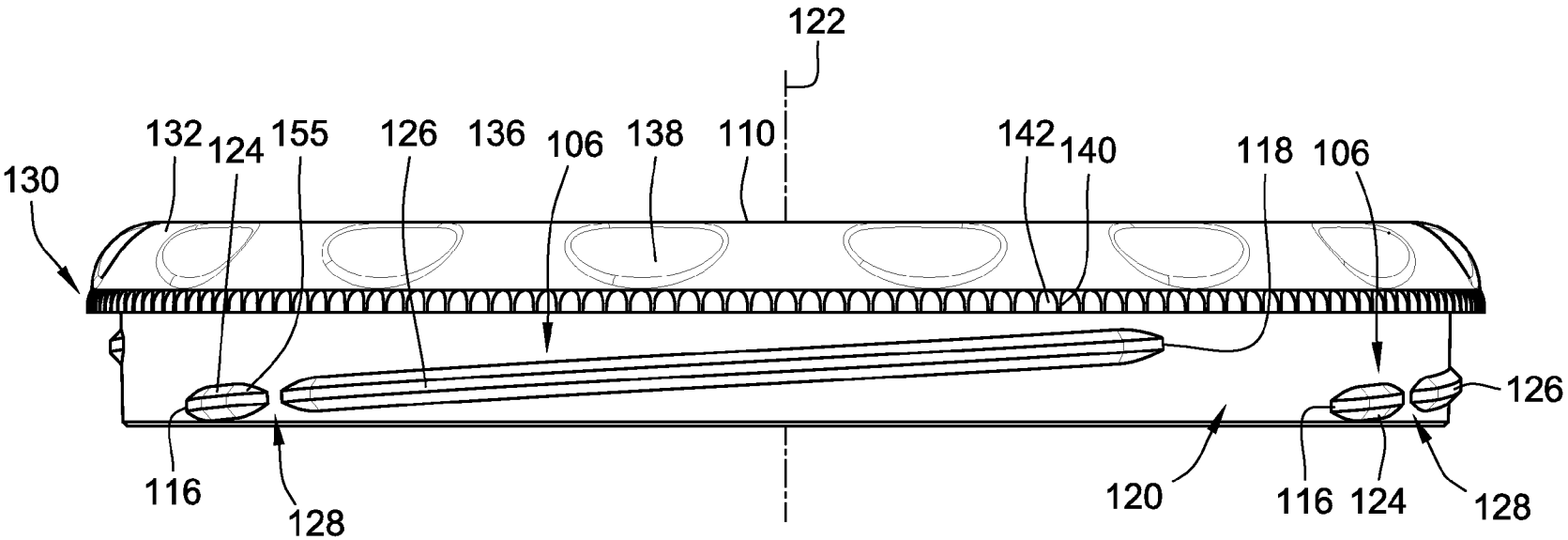
FIG. 3 is a profile view of a container lid of the container of FIG. 1.

With additional reference to FIG. 3, the threads 106 are in the form of locking threads. Thread 106 includes a locking catch portion 124 that forms a leading portion of the thread 106. The locking catch portion 124 is separated from a trailing portion 126 of the thread 106 by a catch gap 128. The locking catch portion 124 will interact with cooperating structure of the container bottom 104, as will be more fully described below, to secure the container lid 102 to the container bottom 104 by preventing rotation therebetween. This interaction will also provide tactile feedback to user when he or she has fully attached the container lid 102 to the container bottom 104.

Figure 4:
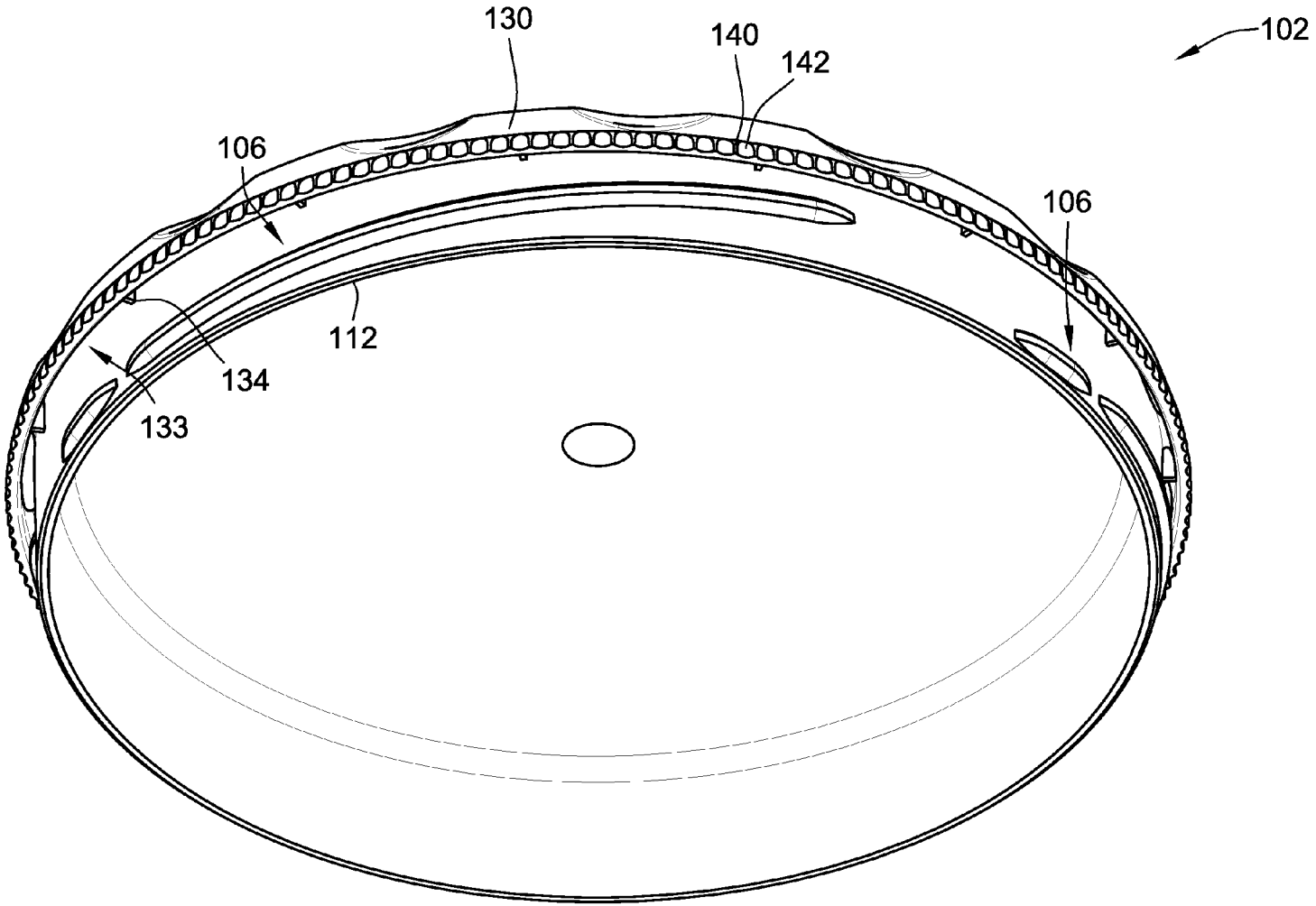
FIG. 4 is a bottom perspective view of the container lid of FIG. 3.
Figure 5:
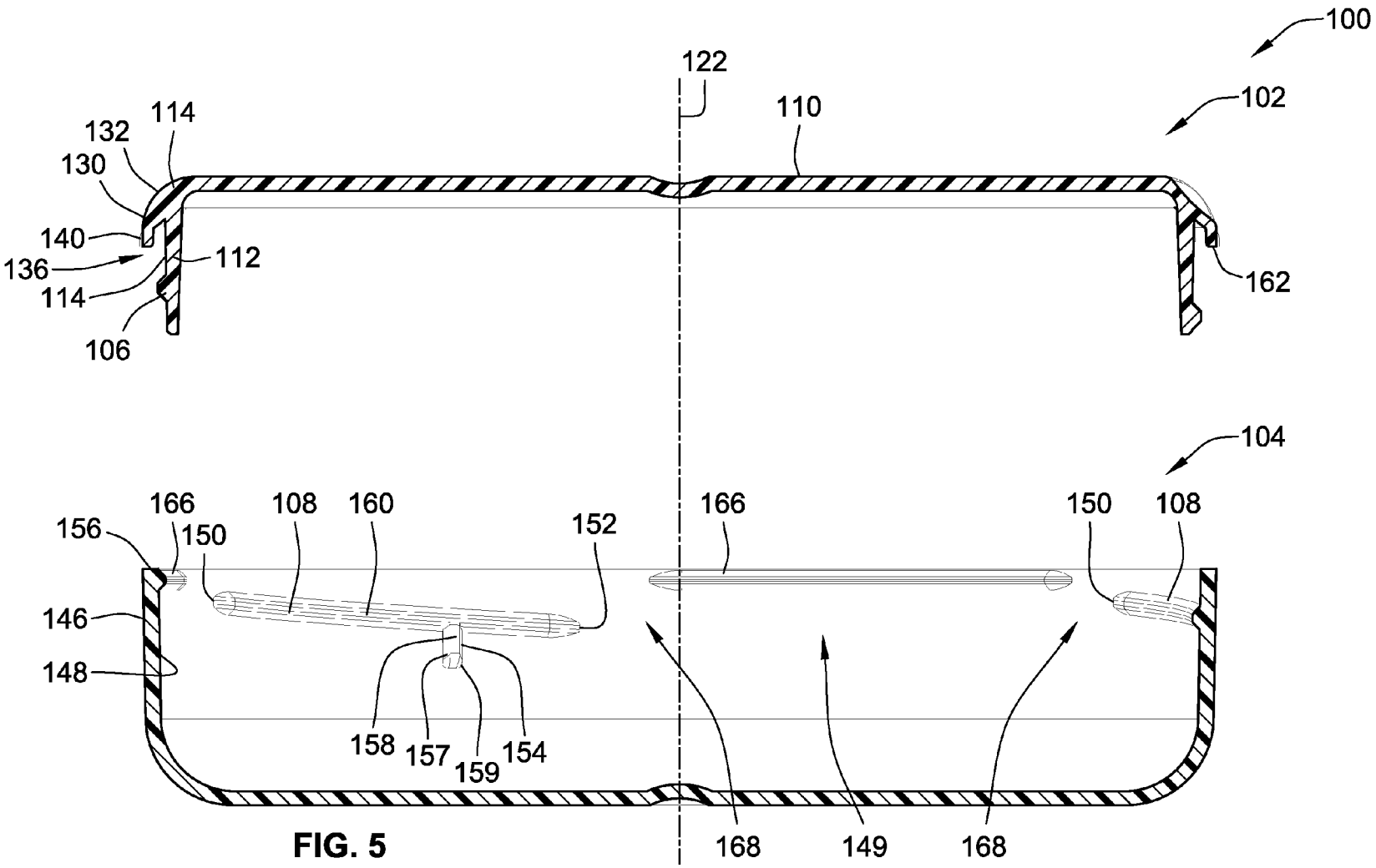
FIG. 5 is cross-sectional exploded illustration of the container of FIG. 1.

With additional reference to FIG. 4, the container lid 102 also includes an outer rim portion 130 that extends radially outward of the skirt portion 112. The rim portion 130 is connected to the top portion 110 by a curved shoulder portion 132. A generally annular groove 133 is formed between the rim portion 130 and the skirt portion 112. Reinforcement ribs 134 may extend radially between an inner surface of rim portion 130 and outer surface 114 of skirt portion 112. The reinforcement ribs 134, skirt portion 112 and rim portion 130 cooperate to form segments of the annular groove 133.

The outer surface 136 of shoulder portion 132 includes a plurality of gripping dimples 138. The gripping dimples 138 are equally angularly spaced apart and are generally concave or dished forming dimples that the user can use to grip the container lid 102 when removing the container lid 102 from the container bottom 104. In a preferred embodiment, the gripping dimples 138 are generally elliptical in cross-section and the major axis MA of the elliptical cross-section is greater than a distance D1 between adjacent ones of the gripping dimples 138.

The outer surface of rim portion 130 includes a plurality of gripping ribs 140 that are used for assembling the container lid 102 onto a container bottom 104, and particularly, transitioning the container lid 102 to a locked state relative to the container bottom 104 during a filling or assembling process during mass filling processes. The gripping ribs 140 extend radially outward and adjacent ribs 140 are separated by adjacent relief channels 142. The gripping ribs 140 and relief channels 142 have a longitudinal axis that is generally parallel to rotational axis 122 of the container 100. The gripping ribs 140 are preferably equally angularly spaced apart by relief channels 142. The relief channels 142 are preferably only angularly bounded by adjacent gripping ribs 140 and open on both axial ends thereof.

With reference to FIG. 2, the container bottom 104 includes a bottom portion 144 from which a generally annular sidewall 146 extends axially therefrom. Threads 108 of the container bottom 104 extend radially inward from an inner surface 148 of sidewall 146.

Adjacent threads 108 are angularly spaced apart such that an angular gap 149 is formed between a leading end 150 of one thread and a trailing end 152 of an adjacent thread. As such, adjacent threads 108 do not axially overlap one another such that no thread is directly above or below an adjacent thread in the axial direction, which is parallel to rotational axis 122.

Preferably, threads 108 and threads 106 have a similar, non-zero, lead angle such that the threads will cooperate with one another as the container lid 102 is threaded onto or off of container bottom 104.

Container bottom 104 includes a locking catch portion 154 that extends radially inward from inner surface 148 of annular sidewall 146. The locking catch portion 154 is positioned axially below threads 108 and will cooperate with locking catch portion 124 and catch gap 128 to provide an anti-rotation arrangement that locks the container lid 102 to the container bottom 104 and prevents rotation therebetween. The locking catch portion 154 is positioned axially along sidewall 146 such that it is interposed between bottom portion 144 and thread 108. Additionally, thread 108 is positioned axially between thread 108 and a distal end 156 of annular sidewall 146. In the illustrated embodiment, the locking catch portion 154 is positioned angularly between leading end 150 and trailing end 152 of the adjacent thread 108. In this embodiment, the locking catch portion 154 and the radially inward extending thread 108 generally form an "L-shaped" portion.

The locking catch portion 154 is generally in the form of a rib or projection that has a longitudinal axis that extends transverse to thread 108 and substantially parallel (i.e. plus or minus 15 degrees from a right angle) to rotational axis 122. In one embodiment, the locking catch portion 154 is formed such that it is directly connected to adjacent thread 108 such that no axial gap is formed therebetween. Further yet, in one embodiment, a radially inner surface 158 or point of the locking catch portion 154 transitions smoothly into a radially inner surface 160 or point of the adjacent thread 108.

The locking catch portion 154 of container bottom 104 will angularly engage locking catch portion 124 of container lid 102 to prevent angular rotation of the container lid 102 relative to container bottom 104. This will prevent the container lid 102 from accidentally unthreading from the container bottom 104 without the user knowing, such as when in a pocket of the user or loosely carried in other objects such as a purse, backpack, vehicle, etc. This avoids undesirably inadvertently spilling the contents therefrom.

In a preferred embodiment, the leading end 116 of locking catch portion 124 is tapered to facilitate easier transitioning of the two locking catch portions 124, 154 angularly past one another. Similarly, a trailing end 155 of the locking catch portion 124 may be similarly tapered. The angular sides 157, 159 of the locking catch portion 154 may have a slight taper to facilitate this bypass.

The catch gap 128 preferably has a width in a generally angular direction, i.e. between locking catch portion 124 and trailing portion 126, that is equal to or slightly greater than the width (i.e. between the angular sides 157, 159) of the locking catch portion 154.

In one embodiment, the container lid 102 and container bottom 104 are configured such that the distal end 162 of rim portion 130 will axially abut distal end 156 of annular sidewall 146 prior to locking catch portion 154 being positioned within catch gap 120 as container lid 102 is threaded onto container bottom 104. This will increase the friction between the container lid 102 and container bottom 104 when the container lid 102 is fully threaded onto container bottom 104 further inhibiting unthreading of the container lid 102 from the container bottom 104.

The outer diameter of skirt portion 112 is sized to be telescopically inserted into annular sidewall 146.

Figure 6:
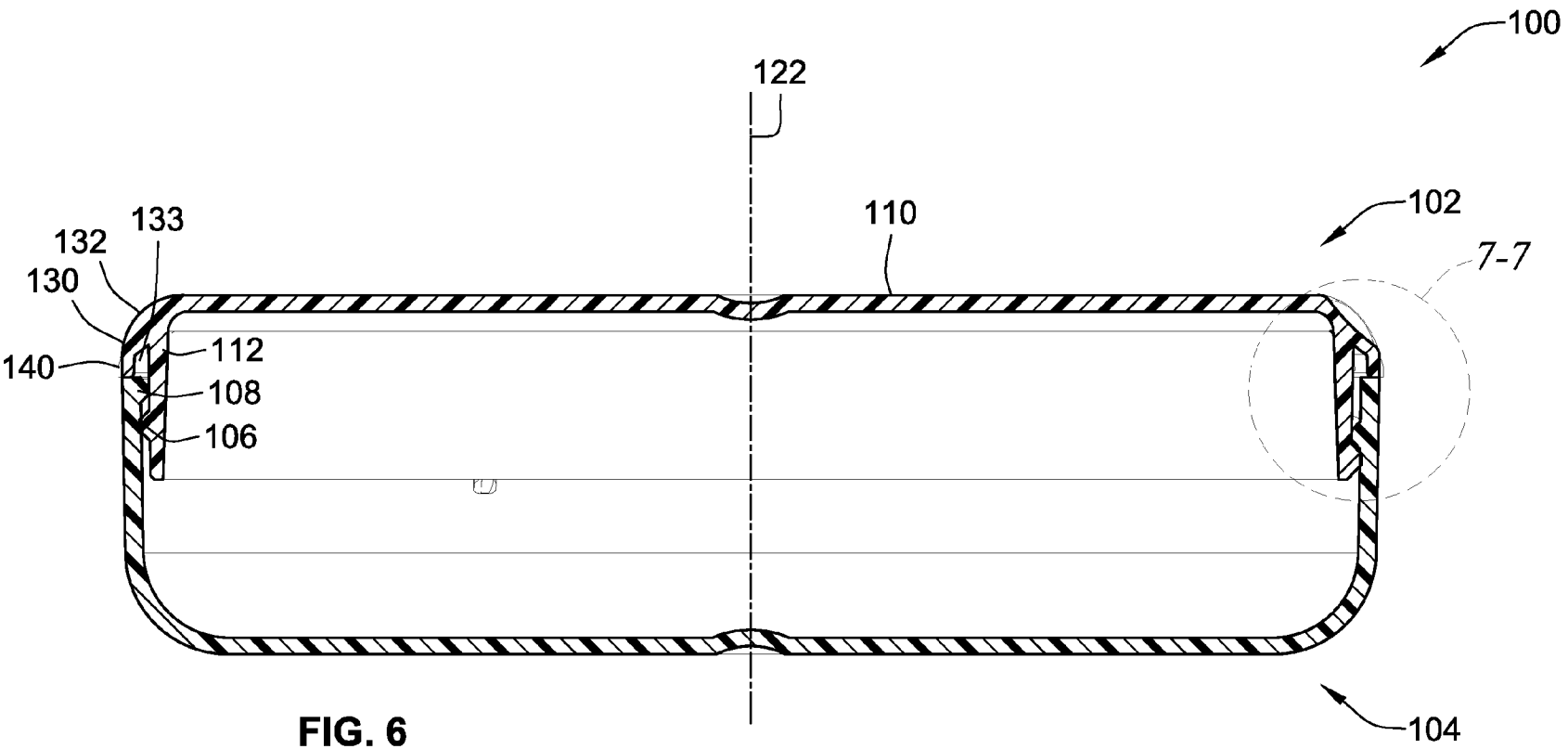
FIG. 6 is an assembled cross-sectional illustration of the container of FIG. 1.

A distal end 162 of rim portion 130 forms an abutment portion that axially abuts the distal end 156 of annular sidewall 146 when the container lid 102 is fully threadedly seated onto container bottom 104, as illustrated in FIG. 6. Distal ends 156, 162 provide abutment surfaces that abut one another when the container lid is in the locked position.

The container bottom 104 includes radially inward extending secondary attachment ribs 166 that extend angularly about rotational axis 122. These secondary attachment ribs 166 are used during assembly and filling operations to assist in axially attaching the container lid 102 to the container bottom 104 prior to twisting the container lid 102 relative to container bottom 104. This is particularly true when a leading end 116 of thread 106 does is angularly interposed between adjacent threads 108.

In the illustrated embodiment, the attachment ribs 166 are angularly positioned between a leading end 150 of one thread 108 and a trailing end 152 of the adjacent thread 108. As such, these attachment ribs 166 compensate for the fact that no portion of thread 108 is present for thread 106 to engage during an initial axial mounting of the container lid 102 to the container bottom 108.

In some embodiments, the attachment ribs 166 and the adjacent threads 108 form annular gaps 168 therebetween such that the attachment ribs 166 and the adjacent threads 108 do not axially overlap. In other words, no portion of the attachment ribs 166 is positioned directly axially inline with any portion of the threads 108. However, in other embodiments this axial over lap may exist.

In some embodiments, the attachment ribs 166 extend radially inward from annular sidewall 146 a shorter distance than threads 108 such that it is easier axially snap fit a container lid 102 onto container bottom 104. This can also be provided by having the inner point or surface 169 have a radius from rotational axis 122 that is greater than the radius from the inner point or surface of threads 108. In some embodiments, the attachment ribs 166 will extend radially inward from inner surface 148 a same distance as threads 108. However, the inner surface 148 will have a slight taper or draft such that the attachment ribs 166 will be positioned radially outward from threads 108.

In the arrangement where the radially inner end of the attachment ribs 166 is radially outward from the radially inner end of the of the threads 108, this difference in radius from the rotational axis 122 makes it easier to snap threads 106 axially there past, but still provides some engagement to secure the lid 102 to container bottom 104 prior to twisting the container lid 102 relative to container bottom 104. Further, these attachment ribs 166 will also provide a cam surface that can interact with threads 106 as the container lid 102 is twisted relative to container bottom 104 causing the container lid 102 to be threaded onto container bottom 104.

Attachment ribs 166 can be considered to have a zero lead angle relative to the rotational axis 122 and extend generally parallel to distal end 156 while threads 108 extend at a non-zero angle relative to distal end 156 and have a non-zero lead angle.

The container lid 102 and container bottom 104 are configured such that the outer surface 170 of rim portion 130 has a same diameter as the outer surface 172 of sidewall 146 at the interface 174 between the distal ends 156, 162. This allows the outer surfaces 170, 172 to be substantially flush at the interface 174.

However, because gripping ribs 140 extend radially outward beyond outer surface 170 of the rim portion 130, the gripping ribs 140 will extend radially outward beyond outer surface 172 of annular sidewall 146. This arrangement facilitates engagement of the gripping ribs 140 with torquing wheels 178 used to lock the container lid 102 to the container bottom during mass assembly processes. Torquing wheels 178 rotate about axes 179 in a same direction. The outer circumference of the torquing wheels 178 engage gripping ribs 140 to rotate the container lid 102 relative to the container bottom 104 to lock the container lid 102 to the container bottom.

The torquing wheels 178 are positioned relative to the container 100 during this process such that the substantially only engage the container lid 102. The torquing wheels may lightly engage the outer surface 172 of the container bottom but only to a limited degree such that only limited interaction occurs between the container bottom and the torquing wheels 178.

Figure 7:
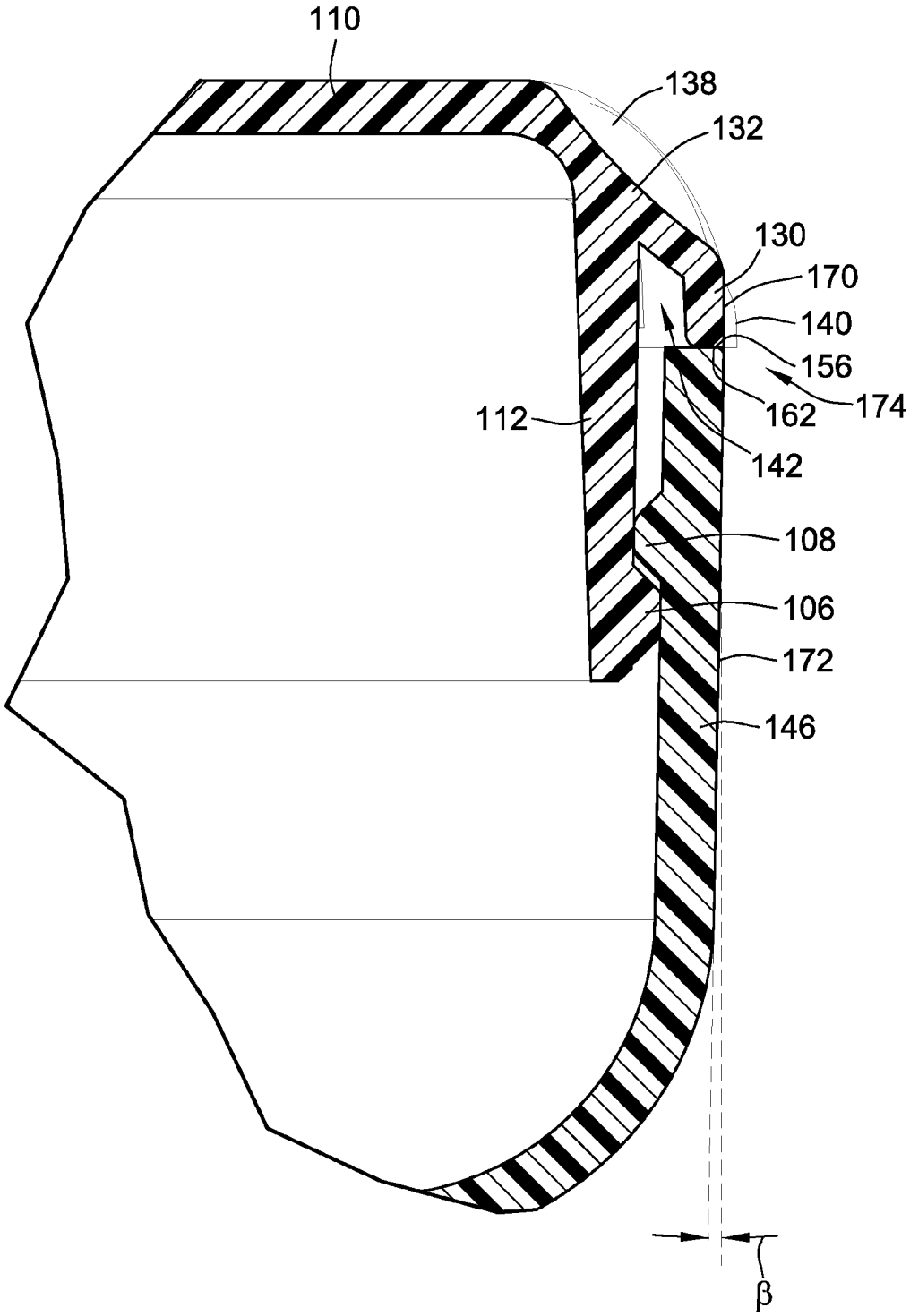
FIG. 7 is an enlarged partial illustration of the cross-sectional illustration of FIG. 6.

To reduce the amount of engagement between the torquing wheels 178 and the container bottom 104, the outer surface 172 of the sidewall 146 may be tapered slightly, such as illustrated by angle β in FIG. 7.

The container bottom 104 will be engaged by a fixturing device 195 (illustrated schematically) to prevent angular rotation thereof about rotational axis 122 during the locking process.

With reference to FIGS. 8*a*-8*d*, the process of assembling the container 100 is illustrated in simplified form.

During mass assembly and filling of containers 100 according to the present invention, product will first be dispensed into container bottom 100, and particularly, the cavity formed by the bottom portion 144 and sidewall 146 thereof. A container lid 102 will then be axially snap fit onto the container bottom 104 and then rotated about rotational axis 122 to angularly engage cooperating threads 106 and 108.

Figure 8A:
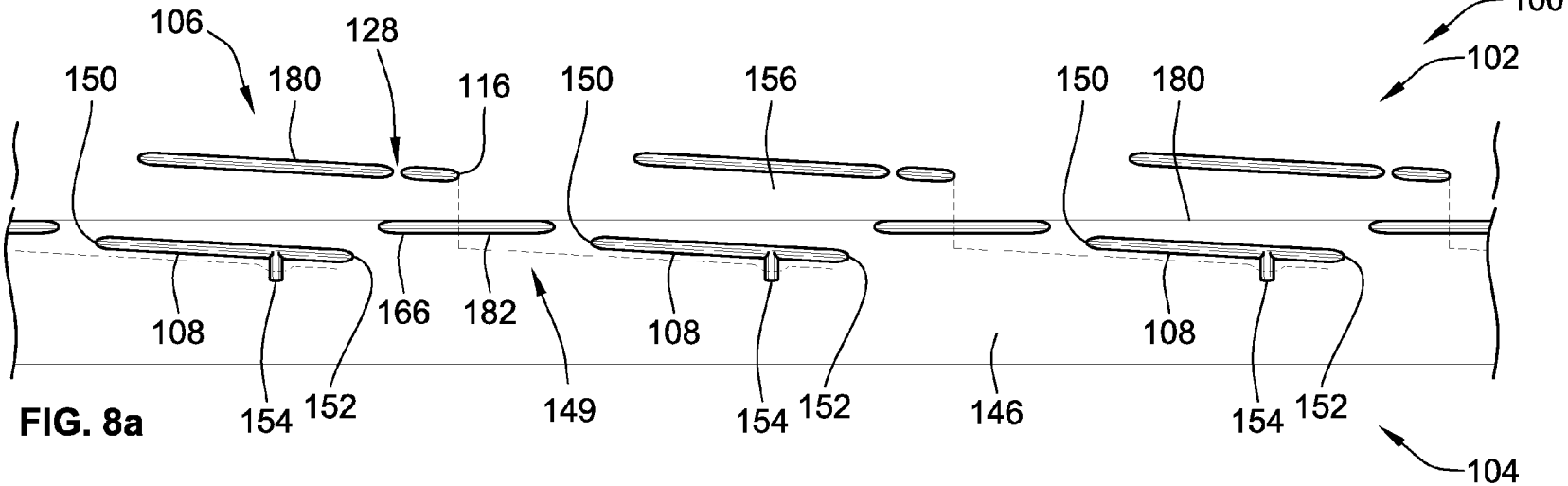
FIGS. 8*a*-8*d* illustrate one process of securing the container lid to the container bottom.
Figure 8B:
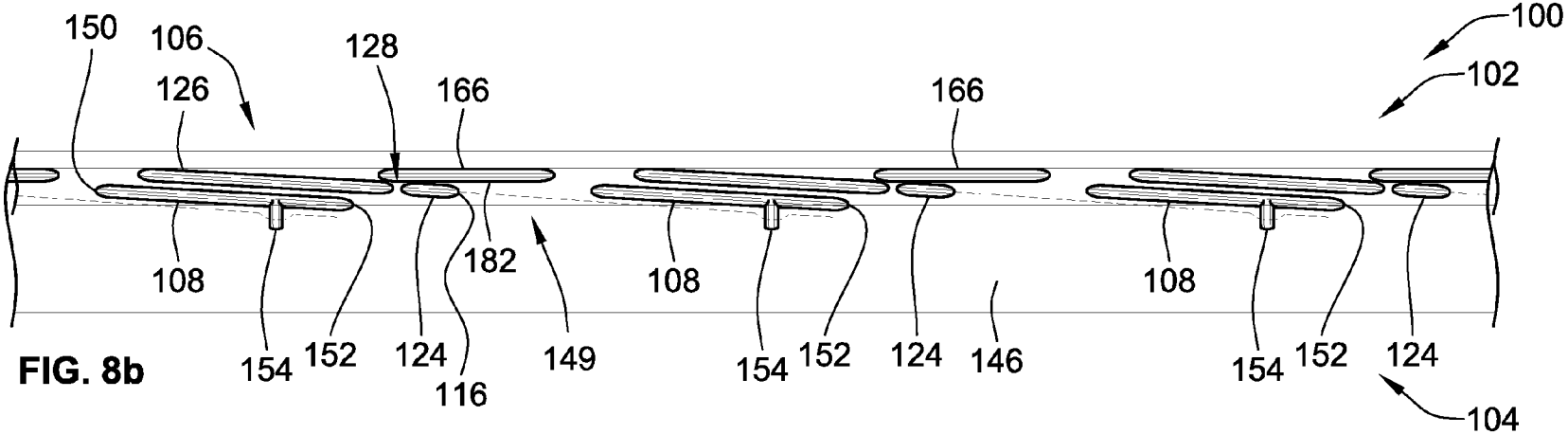

Axially snapping the container lid 102 onto the container bottom 104 is illustrated as the transition from FIG. 8*a* to FIG. 8*b*. In this situation, leading end 116 of thread 106 is angularly positioned between leading end 150 and trailing end 152 of two adjacent threads 108. As such, during this attachment step, the thread 106 will snap engage attachment rib 166 that is angularly interposed between the two adjacent threads 108.

As illustrated in FIG. 8*b*, an axial top surface 180 that faces towards top portion 110 of the container lid 102 will interact with an end and bottom surface 182 of attachment rib 166 to axially secure the container lid 102 to the container bottom 104.

Figure 8C:
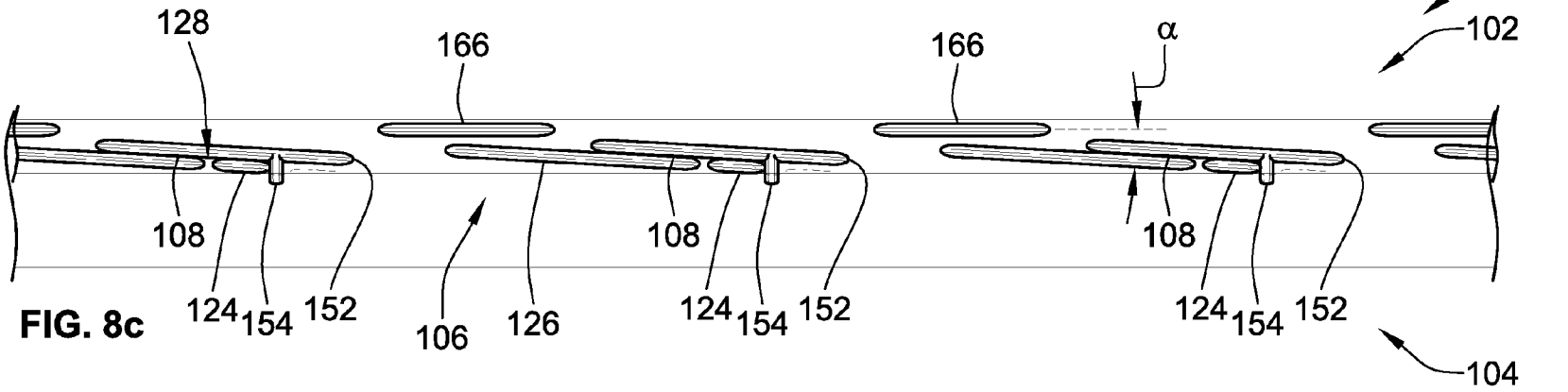

The container lid 102 will then be rotated angularly relative to the container bottom 104. As the container lid 102 rotates, the thread 106 will engage thread 108 of the container bottom 102. This engagement will draw the container lid 102 axially downward. In FIG. 8*c*, the container lid 102 has been rotated such that the locking catch portion 124 has angularly abutted the locking catch portion 154 of the container bottom. At this point, the engagement between the two locking catch portions 154, 124 will inhibit continued rotation.

Figure 8D:
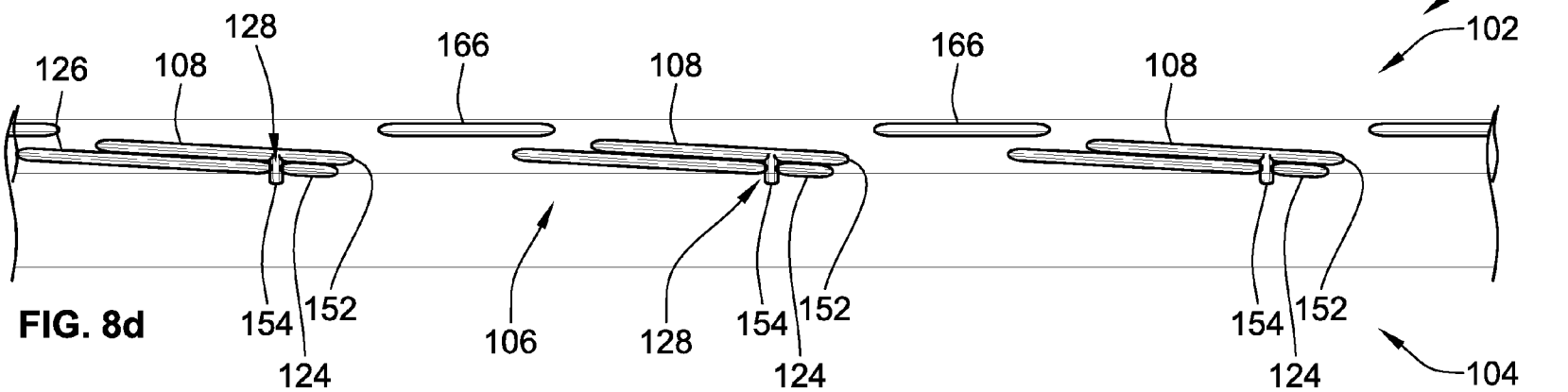

With an increase in torque, the container lid 102 can be rotated to a locked state, illustrated in FIG. 8*d*, wherein the locking catch portion 154 is angularly interposed between locking catch portion 124 and trailing portion 126 of thread 106. In this position, the angular engagement between the two locking catch portions 124, 154 inhibits angular motion of the two container parts relative to one another.

FIGS. 8*a*-8*d* also illustrate that threads 106, 108 have non-zero lead angle values while the attachment ribs 166 are generally horizontal and extend generally parallel to distal end 156 of sidewall 146 about the rotational axis 122. As such, the threads 106, 108 extend at a generally non-zero angle α relative to the attachment rib 166.

During the step of rotation between FIGS. 8*b* and 8*c*, the distal end 162 of the rim portion 130 will preferably axially abut distal end 156 of annular sidewall 146, as mentioned above, to increase friction between the container lid 102 and container bottom 104.

Figure 9A:
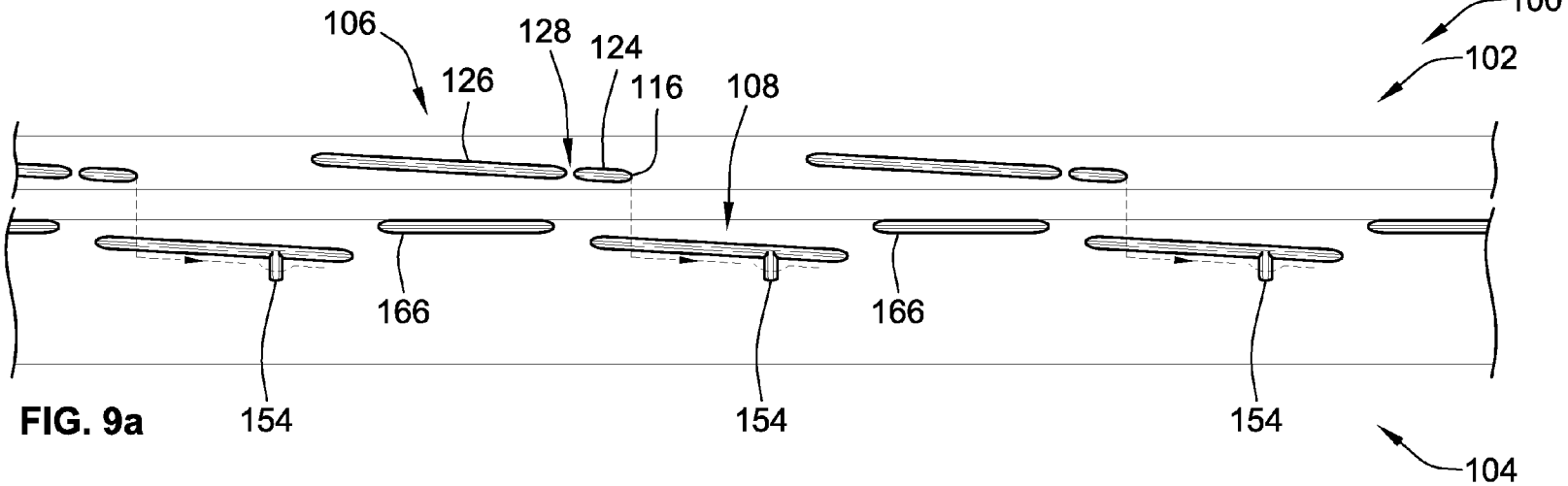
FIGS. 9*a*-9*d* illustrate a further process of securing the container lid to the container bottom.
Figure 9B:
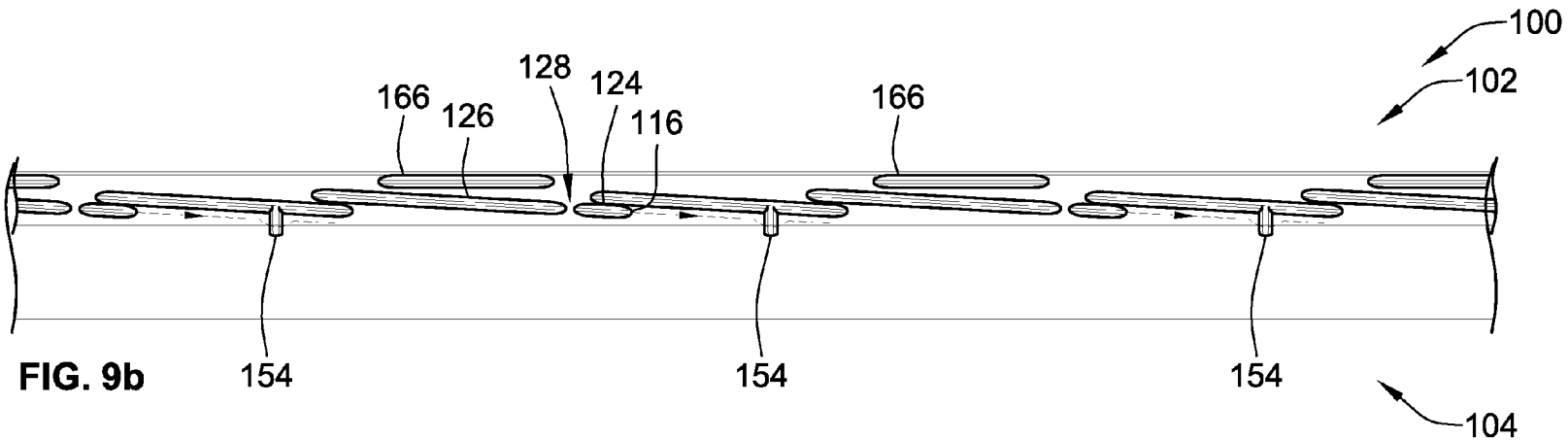
Figure 9C:
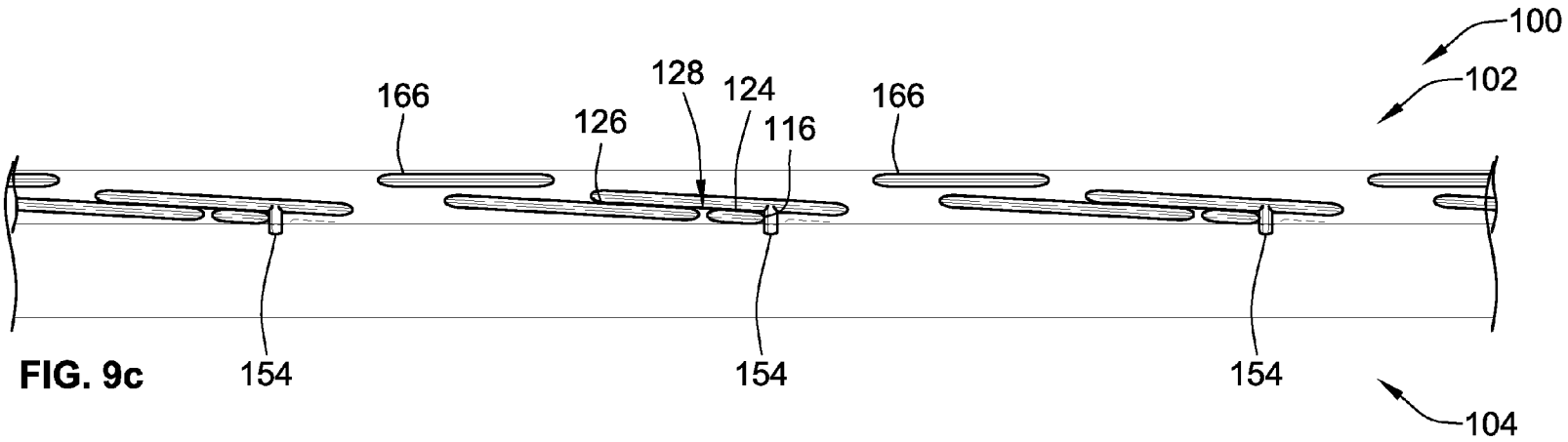
Figure 9D:
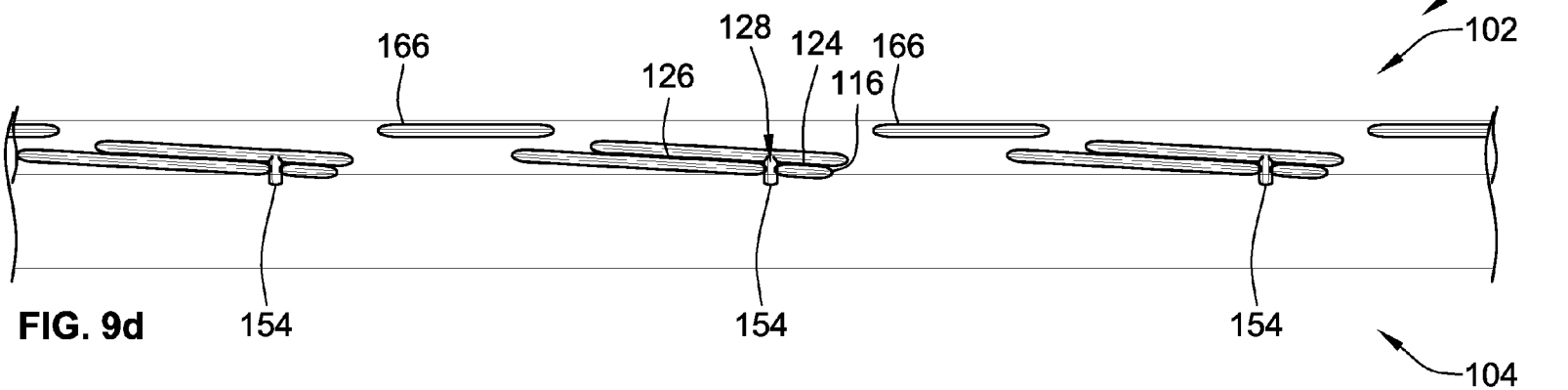
Figure 10:
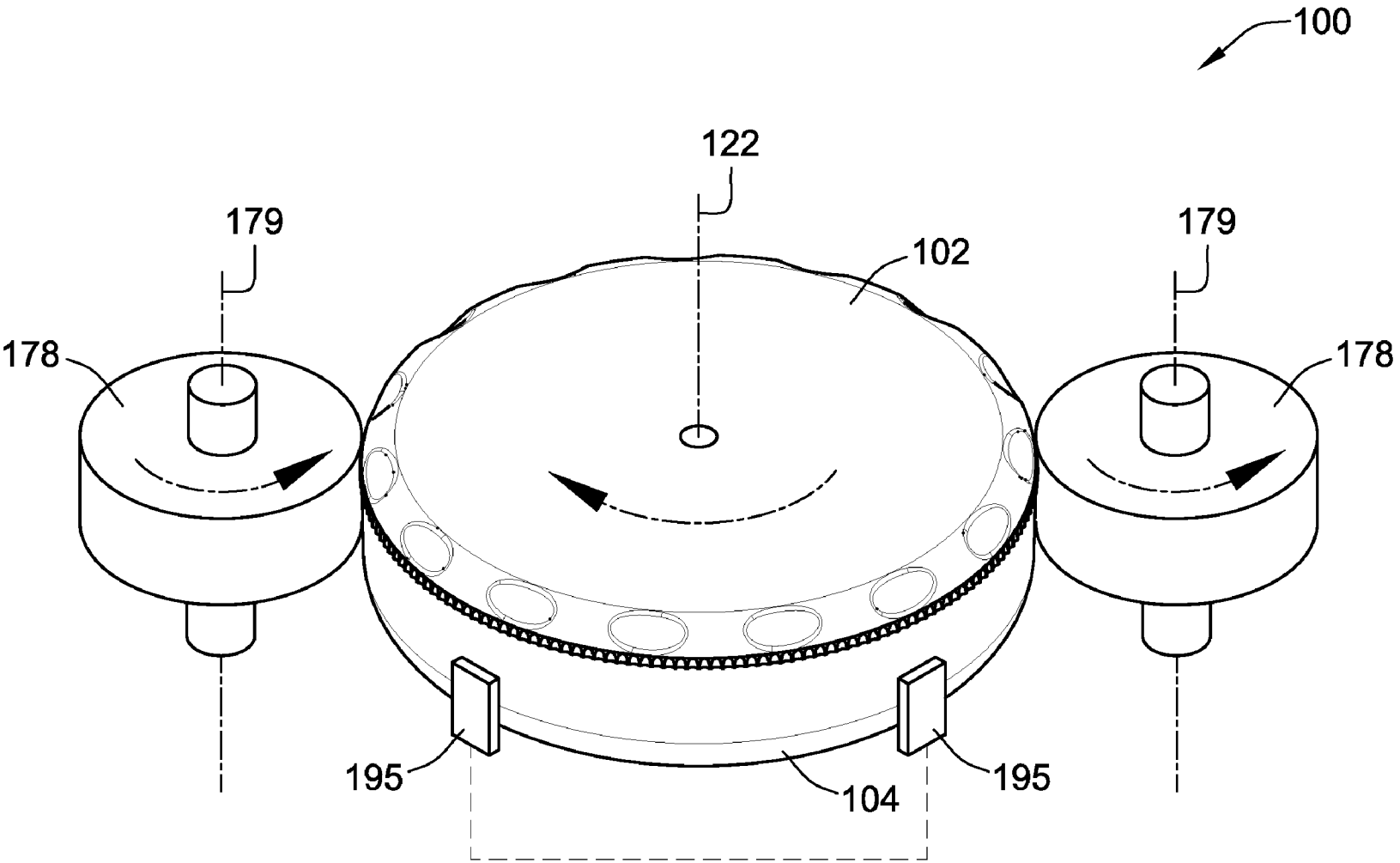
FIG. 10 illustrates a process of twisting a container lid relative to a container bottom.

FIGS. 9*a*-9*d* illustrates a further attachment process. In this process, the lead ends 116 of threads 106 are angularly aligned with a portion of threads 108 such that when the container lid 102 is initially axially snap fit onto the container bottom 104, the two threads 106 and 108 will axially pass one another. In this situation, the container need not rely on the attachment ribs 166 to secure the container lid 102 to the container bottom. FIGS. 9*c* and 9*d* are substantially identical to FIGS. 8*c* and 8*d* and as such, the process illustrated thereby is substantially similar.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a container bottom including a generally annular sidewall defining a storage cavity, the sidewall including a radially inward extending first thread, the sidewall including a radially inward extending attachment rib extending at an angle relative to the radially inward extending first thread;

a container lid including a annular skirt sized to be received into the annular sidewall of the container bottom, the skirt including a radially outward extending thread configured to cooperate with the radially inward extending first thread to threadedly secure the container lid to the container bottom; and wherein the annular sidewall includes a radially inward extending second thread, the attachment rib being angularly interposed between trailing ends of the first and second threads.

2. The container of claim 1, wherein the sidewall of the container bottom includes a first locking catch portion; and wherein the skirt includes a second locking catch portion, the second locking catch portion engaging the first locking catch portion when the container lid is in a locked position relative to the container bottom.

3. The container of claim 1, wherein the first locking catch portion is an axially extending projection projecting radially inward, the axially extending projection being interposed between a bottom of the container bottom and the first radially inward extending thread.

4. The container of claim 3, wherein the second locking catch portion is formed as part of the radially outward extending thread, the second locking catch portion forms a leading portion of the radially outward extending thread that is angularly spaced from a trailing portion of the radially outward extending thread by an angular gap interposed therebetween, the first locking catch portion received within the gap when the container lid is in the locked position relative to the container bottom.

5. The container of claim 4, wherein the first locking catch portion is directly connected to the radially inward extending first thread such that no gap is formed between.

6. The container of claim 5, wherein the first locking catch portion and the radially inward extending first thread generally form an "L-shaped" portion.

7. The container of claim 1, wherein the annular sidewall includes a distal end defining an abutment surface and the container lid includes a radially outward extending rim radially outward of the annular skirt, the abutment surface of the annular sidewall axially abutting an abutment surface of the rim when the container lid is in the locked position relative to the container bottom.

8. The container of claim 1, wherein the annular sidewall has a distal end spaced apart from a bottom portion of the container bottom, the attachment rib extending angularly about a central axis of the annular sidewall generally parallel to the distal end of the annular sidewall.

9. The container of claim 1, wherein adjacent ends of the first and second threads are angularly spaced apart from one another forming an angular gap between the first and second threads, at least a portion of the attachment rib positioned angularly between the adjacent ends of the first and second threads and above a portion of the angular gap.

10. The container of claim 1, wherein the attachment rib does not axially overlap the second thread.

11. The container of claim 1, wherein the first and second threads have a non-zero lead angle and the attachment rib has a zero lead angle.

12. The container of claim 1, wherein the attachment rib is spaced vertically above one of the first and second threads.

13. The container of claim 12, wherein the attachment rib angularly overlaps a portion of the one of the first and second threads.

14. The container of claim 1, wherein the container lid includes an outer rim positioned radially outward from the annular skirt, the outer rim including a plurality of gripping ribs, the gripping ribs extending radially outward beyond an outer surface of the annular sidewall when the container lid is mounted to the container bottom.

15. The container of claim 1, wherein the container lid includes a top portion and an outer rim positioned radially outward from the annular skirt, the container lid includes a shoulder that transitions the top portion into the outer rim, the shoulder includes a plurality of angularly spaced apart gripping dimples.

16. The container of claim 15, wherein the gripping dimples are generally elliptical in cross-section and wherein the spacing between adjacent dimples is less than a major axis of the dimples.

17. A container comprising:

a container bottom including a generally annular sidewall defining a storage cavity, the sidewall including a radially inward extending first thread, the sidewall including a radially inward extending attachment rib extending at an angle relative to the radially inward extending first thread;

a container lid including a annular skirt sized to be received into the annular sidewall of the container bottom, the skirt including a radially outward extending thread configured to cooperate with the radially inward extending first thread to threadedly secure the container lid to the container bottom;

wherein the annular sidewall includes a radially inward extending second thread, wherein adjacent ends of the first and second threads are angularly spaced apart from one another forming an angular gap between the first and second threads, at least a portion of the attachment rib positioned angularly between the adjacent ends of the first and second threads and above a portion of the angular gap; and wherein the attachment rib is positioned entirely angularly between spaced apart ends of the first and second threads such that angular gaps are formed between the first thread and the attachment rib and the second thread and the attachment rib.

* * * * *